US009834234B1

(12) United States Patent
Quiñonez, Jr.

(10) Patent No.: US 9,834,234 B1
(45) Date of Patent: Dec. 5, 2017

(54) BACKUP POWER NOTIFICATION SYSTEM FOR RAILROAD INSTALLATIONS

(71) Applicant: Eduardo Quiñonez, Jr., Burleson, TX (US)

(72) Inventor: Eduardo Quiñonez, Jr., Burleson, TX (US)

( * ) Notice: Subject to any disclaimer, the term of this patent is extended or adjusted under 35 U.S.C. 154(b) by 230 days.

(21) Appl. No.: 14/990,986

(22) Filed: Jan. 8, 2016

Related U.S. Application Data

(60) Provisional application No. 62/101,963, filed on Jan. 9, 2015.

(51) Int. Cl.
*B61L 1/20* (2006.01)
*G08B 3/10* (2006.01)
*B61L 29/08* (2006.01)

(52) U.S. Cl.
CPC ..... *B61L 1/20* (2013.01); *B61L 29/08* (2013.01); *G08B 3/10* (2013.01)

(58) Field of Classification Search
CPC ..... B61L 1/20; B61L 29/08; G08B 21/00; G08B 23/00
USPC ..... 246/473.1
See application file for complete search history.

(56) References Cited

U.S. PATENT DOCUMENTS 6,641,091 B1 * 11/2003 Hilleary ..... B61L 29/08 246/111
6,995,666 B1 * 2/2006 Luttrell ..... B61L 1/20 340/3.1
7,075,427 B1 * 7/2006 Pace ..... B61L 23/06 246/125
2011/0187559 A1 * 8/2011 Applebaum ..... B60Q 1/00 340/907
2014/0210646 A1 * 7/2014 Subramanya ..... B61L 29/28 340/928
2015/0248823 A1 * 9/2015 Jinno ..... G06Q 30/06 340/692

* cited by examiner

*Primary Examiner* — Jason C Smith
(74) *Attorney, Agent, or Firm* — Richard G. Eldredge; Eldredge Law Firm

(57) ABSTRACT

A backup power railroad crossing notification system for a railroad crossing mechanism. The system includes a stationary audible device carried within a railroad housing proximate to a railroad crossing mechanism; a remote mobile device; and a computer carried within the railroad housing. The computer includes a switch conductively coupled to a battery and operably associated with the stationary audible device; and a transceiver in data communication with the mobile device. A method includes wirelessly communicate with the mobile device via the transceiver if power is being drawn from the battery; and activating the stationary audible device if power is being drawn from the battery.

8 Claims, 4 Drawing Sheets

BACKUP POWER NOTIFICATION SYSTEM FOR RAILROAD INSTALLATIONS

BACKGROUND

1. Field of the Invention

The present invention relates generally to backup power notifications systems for railroad installations.

2. Description of Related Art

Backup power notification systems for railroad installations are well known in the art and are effective means to notify maintenance personnel that an installation's backup power mechanism has been engaged. For example, FIGS. 1 and 2 depict a conventional backup power notification system 101 associated with a railroad crossing mechanism 100. The system 101 is stored within the railroad housing 107 and is configured to provide power to the mechanism 100. The system 101 includes a battery 201, relay device 203, and warning light 103 carried by a relay case 105 within a railroad housing 107.

It should be understood that the railroad housing 107 is powered by the city grid (not shown) and the backup power mechanism only engages when the primary power source is disabled due to, for example, inclement weather, vandalism, or maintenance.

As depicted in FIG. 2, when the backup power mechanism engages, the relay device 203 enables the battery 201 to provide power to the warning light 103, which serves to notify maintenance personnel that the primary power must be restored.

A common disadvantage associated with notification system 101 is its limited scope. For example, maintenance personnel working in the daylight may not notice that the warning light 103 is on. It is understood that a railroad installation relying heavily on a backup power mechanism has a limited lifespan and will likely require additional maintenance.

Another common disadvantage associated with system 101 is that it cannot detect the proximity of maintenance personnel or warn anyone that does not have a line of sight on the warning light 103.

Although great strides have been made in the area of backup power notification systems for railroad installations, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
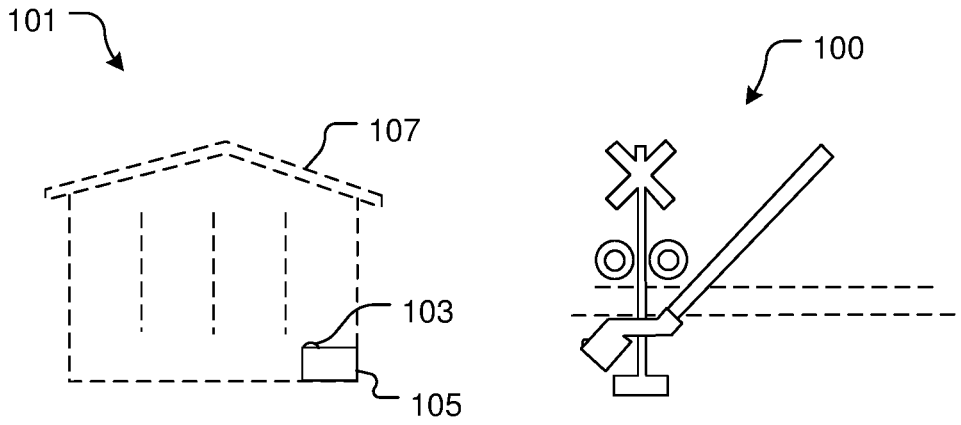
FIG. 1 (Prior Art)
FIG. 1 is a simplified front view of a conventional backup power notification system for railroad crossing mechanisms.
Figure 2:
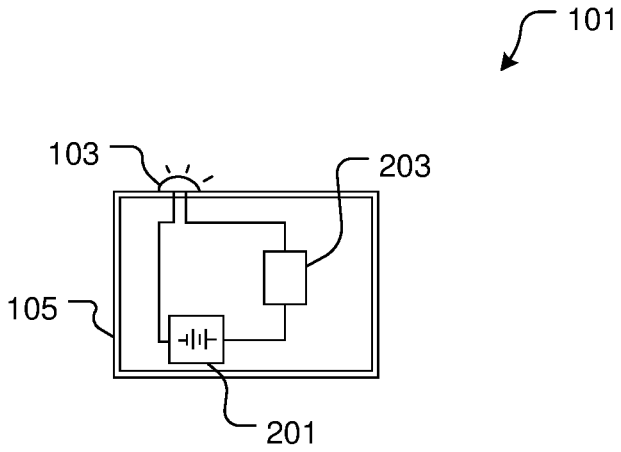
FIG. 2 (Prior Art)
FIG. 2 is a simplified schematic of the notification system of FIG. 1 with the backup power engaged.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional backup power notification systems for railroad stations. Specifically, the system of the present application is configured to transmit audio notification that primary power systems should be restored. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

Figure 3:
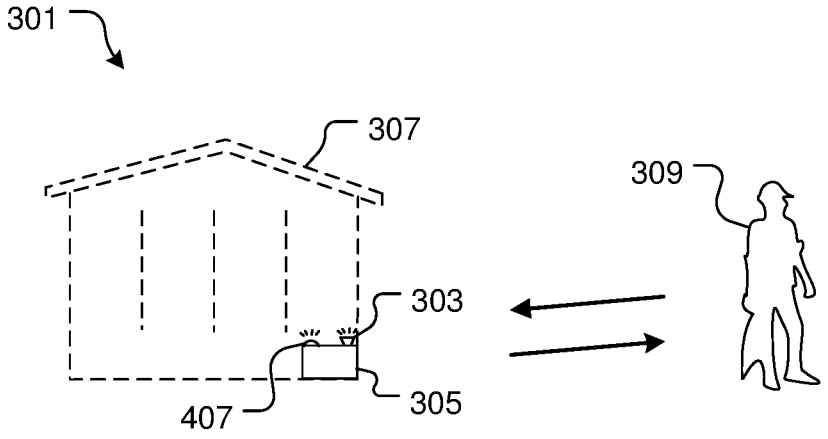
FIG. 3 is simplified front view of a backup power notification system in accordance with a preferred embodiment of the present application.

Referring now to the drawings wherein like reference characters identify corresponding or similar elements throughout the several views, FIG. 3 depicts simplified front view of a backup power notification system 301 in accordance with a preferred embodiment of the present application. It will be appreciated that the system 301 overcomes one of more of the above-listed problems commonly associated with conventional backup power notification systems.

In the contemplated embodiment, system 301 includes a battery 401, one or more relay devices 403, and one or more audible devices 303 (such as an audio chirp) carried by a relay case 305 that is housed within a railroad installation 307.

It will be understood that, when the system 301 is removed from its primary power source (see FIGS. 4A and 4B), the relay devices 403 will engage the battery 401 to power the warning devices 303 which will in turn provide notification to a maintenance worker 309 that primary power is disabled. It will be appreciated that, by allowing a maintenance worker 309 to receive additional, non-visual warnings to restore primary power, the risk that the worker will fail in this task is reduced.

In the contemplated embodiment, the audible device 303 is a transmitter through which the reminder to restore primary power can be sent to a nearby wireless device (not shown) carried by the maintenance worker 309. It will be appreciated that such a reminder can be sent to any mobile device (not shown) and can be archived for record-keeping purposes.

In another contemplated embodiment the system 301 also includes a receiver (not shown) that detects the proximity of a maintenance worker 309 to the railroad installation 307, and enables the engagement of the warning device 303 if the worker becomes too distant from the railroad installation 307 while primary power is disabled.

Figure 4A:
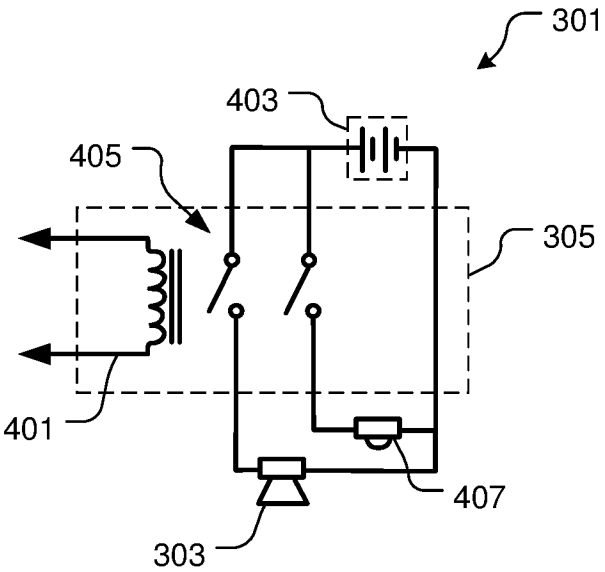
FIG. 4A is a simplified schematic of the notification system of FIG. 3 with the primary power engaged.
Figure 4B:
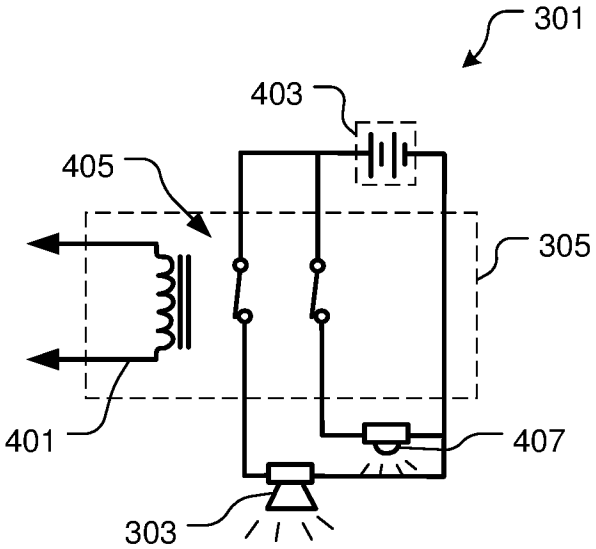
FIG. 4B is a simplified schematic of the notification system of FIG. 3 with the primary power disengaged.

Referring now to FIGS. 4A and 4B a simplified schematic of the system of FIG. 3 is shown with the primary power 401 engaged and disengaged, respectively. As discussed, the system 301 includes a battery 403, one or more relay devices 405, and one or more non-visual warning devices 303 carried by a relay case 305. A visual warning device 407 is also shown.

One of the unique features believed characteristic of the present application is that it employs one or more non-visual methods for warning railroad staff that a railroad installation is running on backup power and may require reengagement with its primary power source.

Additional unique features believed characteristic of the present application include that the warnings provided by the system 301 can be triggered by the proximity of the maintenance worker 309 and need not rely on line of site. Also, the warnings can be sent to the maintenance worker 309 directly to prevent the worker from leaving the installation while it is running on backup power; or the warnings may be sent to third party personnel to audit and address the thoroughness of the maintenance crews.

Figure 5:
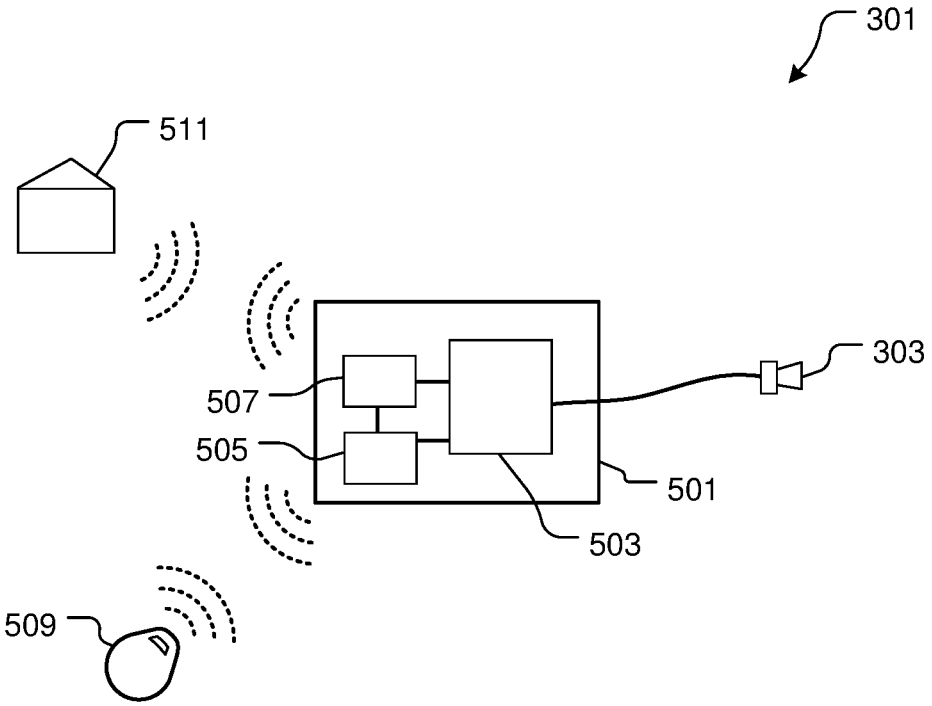
FIG. 5 is a simplified schematic of the notification with range finder system of FIG. 3.
Figure 6:
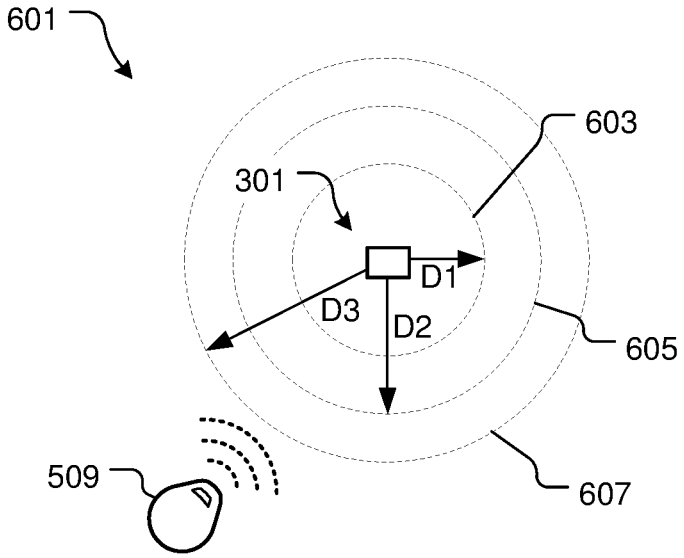
FIG. 6 is a simplified schematic of the range finder of the notification system of FIG. 3.

Referring now to FIGS. 5-7, the features of system 301 are further defined and shown during use. System 301 includes a computer 501 having a processor 503 in data communication with the railroad crossing mechanism 100. The computer is configured to activate the audible device 303 when the battery is being drawn. System 301 is further provided with a range finder 505 and a transceiver 507 operably associated with processor 503. In the contemplated embodiment, transceiver 507 detects the presence of and relays a signal to a remote device 509 carried by the worker 309. In the exemplary embodiment, the remote device 509 is a key fob configured to securely attach to the keys of the worker (not shown). The key fob can be configured to emit a signal, for example, one or more of a light, vibration or audible noise signal that can be seen, felt, or heard by the worker or third party. It will be appreciated that a mobile phone and/or other similar device could also receive the signal from transceiver 507. For example, a smartphone could include an application that receives and notifies the worker in the event that the backup battery is being drawn. Such notifications could be a phone call, text message, ring tone, and the like.

In lieu of or in addition to sending a signal to device 509, it is also contemplated incorporating the features of alerting a third party such as a control office 511 via wireless transmission, e.g., cellular data communication. Thus, another worker can be notified via transceiver 507.

It should be understood that as the worker leaves the railroad housing, the distance between the transceiver 507 and the device 509 increases, thus limiting the type of signal that can be transmitted. Accordingly, it is contemplated using a range finder 505 configured to send a signal to the device 509, and if no signal is received in return, to switch between a second stronger signal, as indicated in FIG. 6, and discussed more fully below.

In FIG. 6, the features of the range finder 505 are shown. The range finder 505 is configured to send a wireless transmission via transmitter 507 within a determined range area 601 and to determined the distance the device 509 is relative to the railroad housing. As indicated by circles 603, 605, and 607, the respective distances D1, D2, and D3 requires the range finder 505 to switch between different signal transmission types, for example, Bluetooth, WiFi, and/or GPS. Thus, the further the device 509 from the railroad housing, the higher powered signal is transmitted. The range finder is thus configured to determine the range distance of the mobile device via the transceiver 507 and processor 503.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A backup power railroad crossing notification system for a railroad crossing mechanism, the system comprising:
- a stationary audible device carried within a railroad housing proximate to a railroad crossing mechanism;
- a remote mobile device; and
- a computer carried within the railroad housing, having:
  - a switch conductively coupled to a battery and operably associated with the stationary audible device; and
  - a transceiver in data communication with the mobile device;
- wherein the computer is configured to wirelessly communicate with the mobile device via the transceiver if power is being drawn from the battery; and
- wherein the computer is configured to activate the stationary audible device if power is being drawn from the battery.

2. The system of claim 1, wherein the remote mobile device is a key fob.

3. The system of claim 1, wherein the remote mobile device is a mobile phone.

4. The system of claim 1, wherein the remote mobile device emits an audible sound.

5. The system of claim 1, the system further comprising:
- a range finder configured to determine the distance the remote mobile device is relative to the railroad housing and configured to change between signal strengths as determined by the distance the mobile device is relative to the railroad housing.

6. The system of claim 1, wherein the transceiver communicates with a third party transceiver.

7. A method, comprising:

providing the system of claim 1;

wirelessly communicate with the mobile device via the transceiver if power is being drawn from the battery; and activating the stationary audible device if power is being drawn from the battery.

8. The system of claim 7, the method further comprising:

determining a distance the remote mobile device is relative to the railroad housing; and changing between transmitted signal strengths as determined by the distance the mobile device is relative to the railroad housing.

* * * * *